US009516965B2

(12) United States Patent
Cohen

(10) Patent No.: US 9,516,965 B2
(45) Date of Patent: Dec. 13, 2016

(54) HOSIERY DONNING DEVICE

(71) Applicant: Assistive Design Concepts LLC, Raleigh, NC (US)

(72) Inventor: Alan Cohen, Cary, NC (US)

(73) Assignee: Assistive Design Concepts LLC, Raleigh, NC (US)

( * ) Notice: Subject to any disclaimer, the term of this patent is extended or adjusted under 35 U.S.C. 154(b) by 25 days.

(21) Appl. No.: 14/173,565

(22) Filed: Feb. 5, 2014

(65) Prior Publication Data

US 2014/0151412 A1 Jun. 5, 2014

Related U.S. Application Data

(63) Continuation-in-part of application No. 13/155,606, filed on Jun. 8, 2011, now abandoned.

(60) Provisional application No. 61/353,241, filed on Jun. 10, 2010.

(51) Int. Cl.
*A47G 25/90* (2006.01)

(52) U.S. Cl.
CPC ..... *A47G 25/905* (2013.01)

(58) Field of Classification Search
CPC ... A47G 25/905; A47G 25/907; A47G 25/908
See application file for complete search history.

(56) References Cited

U.S. PATENT DOCUMENTS 1,389,525 A 8/1921 Mosby
D90,286 S * 7/1933 Josephs ..... 223/118
2,366,097 A * 12/1944 Gesell ..... A47G 25/82 223/118
2,894,669 A * 7/1959 Silken ..... A47G 25/905 223/111
3,501,073 A 3/1970 Breithor
3,800,789 A 4/1974 Schloss
3,883,052 A * 5/1975 Wilson ..... A47G 25/905 223/111
4,651,909 A 3/1987 Banting
4,789,087 A * 12/1988 Doorenbos ..... A47G 25/905 223/111
5,151,081 A 9/1992 Williams
5,275,068 A * 1/1994 Wrench ..... A01B 1/22 30/296.1

(Continued)

FOREIGN PATENT DOCUMENTS

WO 9933381 A1 7/1999

OTHER PUBLICATIONS

International Search Report and Written Opinion of the International Searching Authority dated May 7, 2015 of International PCT Application No. PCT/US2015/014438 filed on Feb. 4, 2015.

*Primary Examiner* — Shaun R Hurley
*Assistant Examiner* — Andrew W Sutton
(74) *Attorney, Agent, or Firm* — Sorell, Lenna & Schmidt LLP

(57) ABSTRACT

Devices and methods to assist a user in donning hosiery are provided. The device comprises an elongated flexible blade extending between a distal end and a proximal end, the blade configured to contact at least a portion of a user's foot, the blade having a textured inner surface configured to face towards the user's lower leg, and an smooth opposing outer surface relative to the textured inner surface.

20 Claims, 8 Drawing Sheets

(56) References Cited

U.S. PATENT DOCUMENTS

| | | | | |
|---|---|---|---|---|
| 5,356,057 | A * | 10/1994 | Vossen | A47G 25/907 223/111 |
| 5,603,692 | A | 2/1997 | Maxwell | |
| 5,776,090 | A | 7/1998 | Bergmann | |
| 5,799,659 | A * | 9/1998 | Stano | A61F 5/0111 128/882 |
| 6,426,132 | B1 * | 7/2002 | Stewart | A47G 25/82 223/118 |
| 6,695,182 | B1 | 2/2004 | Shrewsbury | |
| 7,234,616 | B2 * | 6/2007 | Thom | A47G 25/905 223/1 |
| 7,337,933 | B1 | 3/2008 | Klinberg | |
| 8,356,735 | B1 * | 1/2013 | Drakeford | A47G 25/905 223/112 |
| 2004/0069820 | A1 * | 4/2004 | Van Loef | A47G 25/908 223/111 |
| 2007/0062986 | A1 | 3/2007 | Doud | |
| 2007/0187441 | A1 | 8/2007 | Klinberg | |
| 2012/0228343 | A1 | 9/2012 | Brobeg | |
| 2014/0151412 | A1 * | 6/2014 | Cohen | A47G 25/905 223/111 |
| 2015/0313396 | A1 * | 11/2015 | Carlson | A47G 25/905 2/239 |

* cited by examiner

HOSIERY DONNING DEVICE

This application claims the benefit of the filing date of and is a Continuation-in-Part of U.S. application Ser. No. 13/155,606, filed on Jun. 8, 2011, which is co-pending, entitled "Compression Stocking Donning Device" which claims the benefit of the filing date of U.S. Provisional Application No. 61/353,241 filed on Jun. 10, 2010, and entitled "Compression Stocking Donning Device." These entire disclosures are hereby incorporated by reference into the present disclosure.

BACKGROUND

The present disclosure relates to devices that assist a user in the donning of a compression garment such as compression hose.

Compression garments such as compression stockings, for example, are widely used to treat a variety of different vascular and circulatory disorders. Generally, patients wear such garments around a limb, such as an arm or a leg, that require compression therapy. The idea is that the compression garment applies a controlled, compressive force to the limb to improve blood flow through the limb. The improved blood flow helps treat or manage certain vascular and/or circulatory conditions, such as deep vein thrombosis (DVT), post-thrombotic syndrome (PTS), swelling, varicose veins, and in some cases, may help to heal ulcerations.

Compression garments are typically manufactured from an elastic material that stretches around the limb but is extremely tight fitting. Because of this tight fit, they are notoriously difficult for people to put on and take off. For example, many elderly people wear compression hose or compression stockings that fit around a foot and at least part of a leg. Because of their age and/or their condition, their strength and dexterity may be limited, thereby making the already laborious process of pulling the compression stocking over the foot and leg even more arduous. Therefore, there is a need for new compression stocking donning devices and methods that can easily allow donning of the compression stocking.

SUMMARY

The current stocking donning devices and methods allow easy donning of the compression stockings. Accordingly, a flexible device that assists a user in donning a compression garment, such as compression hose is provided. Generally, the device includes a flexible elongated blade. The blade is configured to contact at least a portion of a user's foot. The blade comprises an inner surface configured to face towards the user's lower leg and an opposing smooth outer surface. The inner surface being concave and the outer surface being convex. The inner surface is textured relative to the smooth outer surface and the textured inner surface of the blade comprises ridges to prevent the device from inadvertently slipping relative to the user's leg and/or foot while the user dons the compression hose. The outer surface is smooth to reduce friction between the compression hose and the blade. This reduced friction allows the compression hose to slide over the device thereby making it easier for the user to don the tight-fitting compression hose.

In some embodiments, a device is provided that assists a user in donning hosiery. The device comprises a flexible elongated blade. The blade is configured to be flexible such that the blade is bendable to contact at least a portion of the user's foot. The blade comprises an inner surface configured to face towards a portion of the user's lower leg and an opposing smooth outer surface. The inner surface has a concave portion and the outer surface has a convex portion. The inner surface has at least a portion that is textured relative to the smooth outer surface and at least a portion comprising a plurality of ridges configured to grip at least a portion of the user's foot. The blade comprises a raised portion extending from the smooth outer surface and is configured to create a space between a surface such that at least a portion of the user's foot is positioned above the raised portion on or adjacent the inner surface on the plurality of ridges. The blade further comprises a handle positioned at the proximal end of the blade where the handle is offset from a longitudinal axis.

In various embodiments, a method of donning hosiery using a donning assistance device is provided. The method comprises providing a device to assist a user in donning hosiery comprising an elongated blade extending between a distal end and a proximal end. The blade is configured to be flexible such that the blade is bendable and contacts at least a portion of the user's foot. The blade comprises a textured inner surface configured to face the user's lower leg and an opposing smooth outer surface relative to the textured inner surface configured to face a supporting surface that at least a portion of the user's foot is positioned above.

In some embodiments, the method of donning hosiery further comprises placing the device on the supporting surface, placing the user's foot on the inner surface of the device, capturing the device and the user's foot with the hosiery, pulling the hosiery to the ankle, pulling the hosiery over the heel, raising the user's foot and pulling the hosiery up the user's lower leg, and releasing the device from the hosiery.

Additional features and advantages of various embodiments will be set forth in part in the description that follows, and in part will be apparent from the description, or may be learned by practice of various embodiments. The objectives and other advantages of various embodiments will be realized and attained by means of the elements and combinations particularly pointed out in the description and appended claims.

BRIEF DESCRIPTION OF THE DRAWINGS

In part, other aspects, features, benefits and advantages of the embodiments will be apparent with regard to the following description, appended claims and accompanying drawings where:

DETAILED DESCRIPTION

Figure 1:
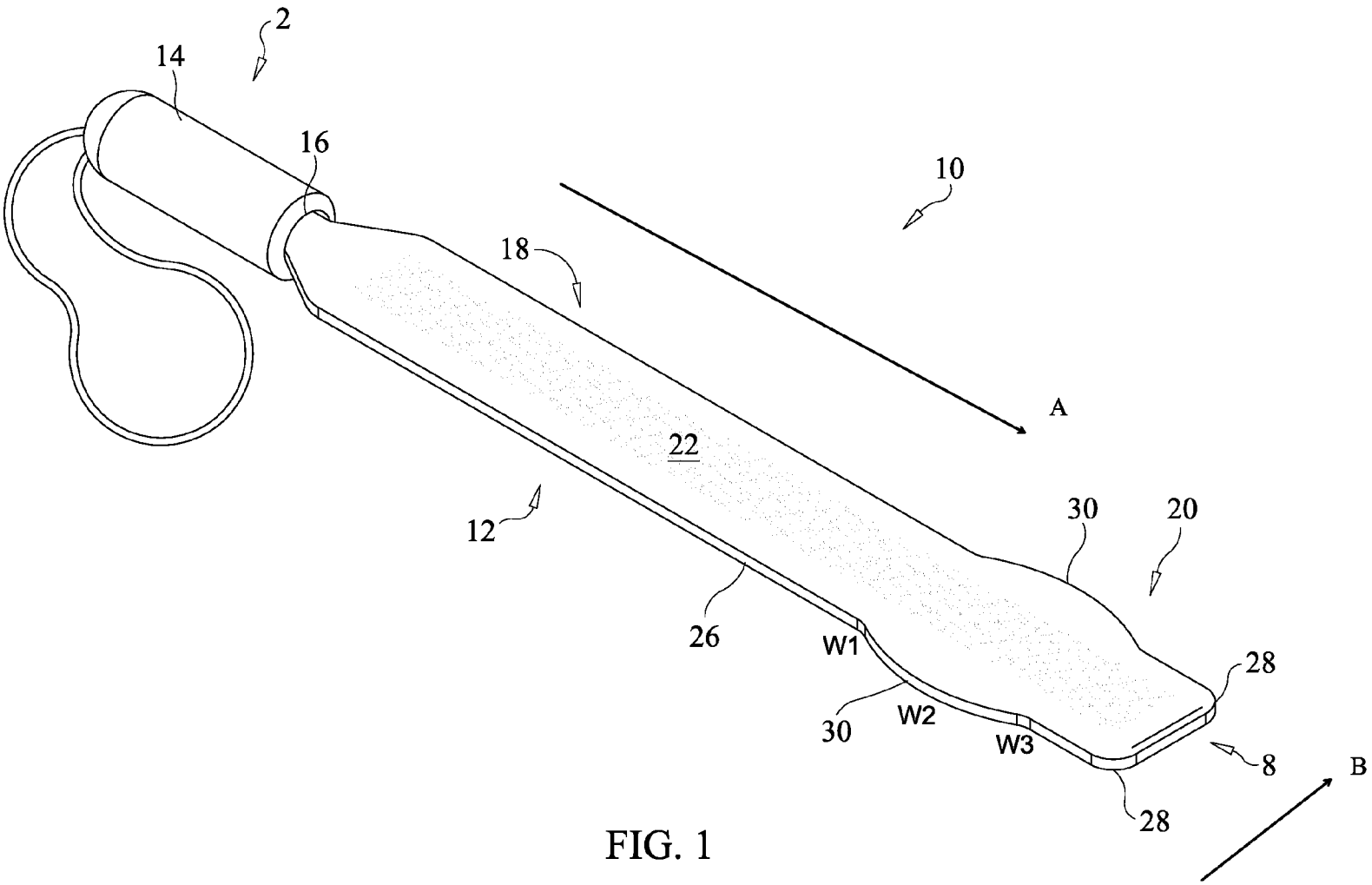
FIG. 1 is a perspective view of one embodiment of a device according to the principles of the present disclosure.

For the purposes of this specification and appended claims, unless otherwise indicated, all numbers expressing quantities of ingredients, percentages or proportions of materials, reaction conditions, and other numerical values used in the specification and claims, are to be understood as being modified in all instances by the term "about." Accordingly, unless indicated to the contrary, the numerical parameters set forth in the following specification and attached claims are approximations that may vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all subranges subsumed therein. For example, a range of "1 to 10" includes any and all subranges between (and including) the minimum value of 1 and the maximum value of 10, that is, any and all subranges having a minimum value of equal to or greater than 1 and a maximum value of equal to or less than 10, e.g., 5.5 to 10.

It is noted that, as used in this specification and the appended claims, the singular forms "a," "an," and "the," include plural referents unless expressly and unequivocally limited to one referent. Thus, for example, reference to "a ridge" includes one, two, three or more ridges.

Reference will now be made in detail to certain embodiments of the invention, examples of which are illustrated in the accompanying drawings. While the invention will be described in conjunction with the illustrated embodiments, it will be understood that they are not intended to limit the invention to those embodiments. On the contrary, the invention is intended to cover all alternatives, modifications, and equivalents, which may be included within the invention as defined by the appended claims.

The headings below are not meant to limit the disclosure in any way; embodiments under any one heading may be used in conjunction with embodiments under any other heading.

Donning Device

New donning devices are provided that can help a user put on compression garments, such as, for example, prescription strength therapeutic compression hosiery. The donning device greatly reduces the friction normally associated with putting on compression garments over a user's foot and lower leg. One advantage of the donning device is that it is flexible to bend, conform and/or contact the outline of at least a portion of a user's foot and/or lower leg. As used herein a "flexible" device refers to devices that are capable of being flexed, bent, bowed and/or twisted by hand, without breaking. The inner surface of the donning device is textured to prevent the device from inadvertently slipping relative to the user's leg and/or foot while the user dons the compression hose. "Textured," as used herein, refers to the local deviations of the topography of a surface from a perfectly flat plane (e.g., ridges, protrusions, etc). Surface texture is one of the important factors that control friction. The user maneuvers the device by the gripping surface of the handle grip. "Gripping surface," as used herein, refers to a surface, such as, for example, a sleeve, ergonomically designed to promote a strong hold on an object. "Tribological properties," as used herein, refers to the properties of interacting surfaces that are in relative motion. Tribological properties include friction, lubrication, and/or wear of interacting surfaces. "Hosiery," as used herein, includes compression and non-compression stocking and/or socks.

Figure 2:
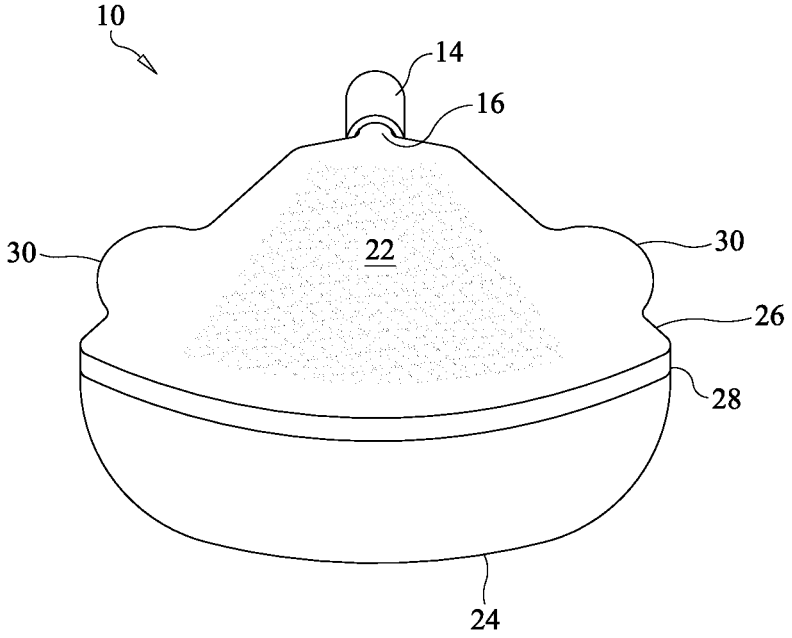
FIG. 2 is a front view of components of the device, as shown in FIG. 1.
Figure 3:
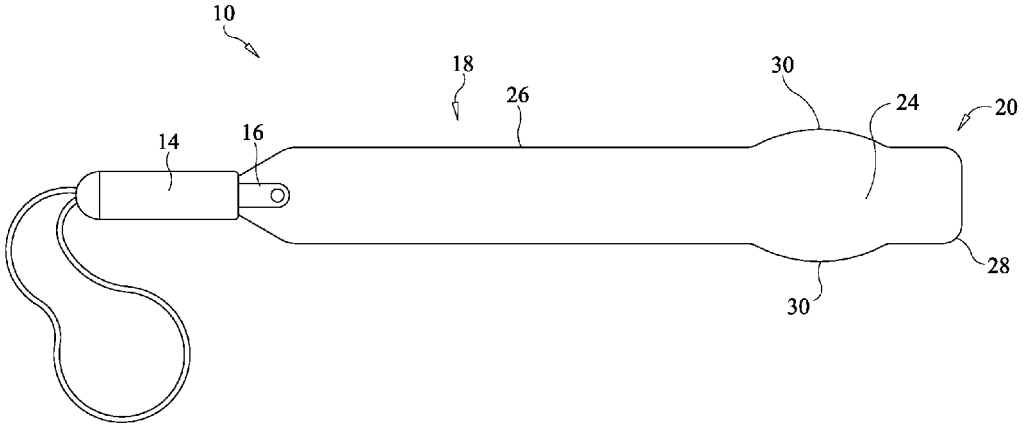
FIG. 3 is a back view of components of the device, as shown in FIG. 1.
Figure 4:
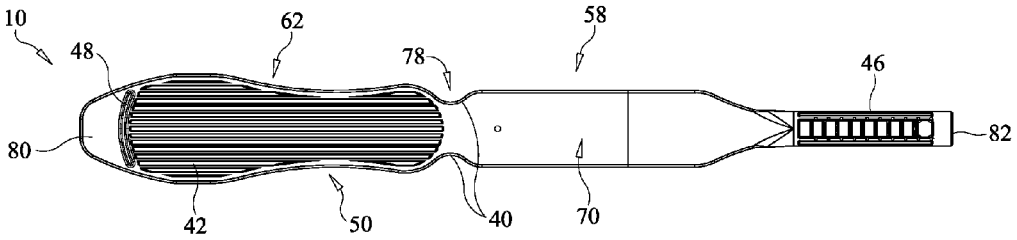
FIG. 4 is a top view of one embodiment of a device according to the principles of the present disclosure.

In one embodiment, as shown in FIGS. 1-3, a donning device 10 is configured to assist a user in donning a compression garment, such as, for example, a prescription strength therapeutic compression hosiery. The device comprises an elongated, flexible blade 12 extending between a distal end 8 and an opposing proximal end 2. A longitudinal axis A extends between the distal and proximal ends and a transverse axis B extends along the distal end. In one embodiment, the proximal end includes a handle 16 configured to maneuver the flexible blade.

In one embodiment, the blade comprises a leg section 18 and a foot section 20. The blade is bendable such that the leg section bends, conforms and/or contacts a rear profile of at least a portion of a user's lower leg, and the foot section conforms and/or contacts to a profile of at least a portion of a user's foot. In some embodiments, the foot section conforms to a sole, sides and/or heel of the user's feet. The blade includes an inner surface 22 and an opposing outer surface 24. In one embodiment, the inner surface is concave and the outer surface is convex, and is configured for disposal with a user's foot. The leg section and the foot section extend from the bottom of a user's forefoot to a user's lower calf, and conforms and/or contacts substantially to that profile.

In one embodiment, the blade includes an edge 26 defining a perimeter. The perimeter defines the shape of the blade. In one embodiment, the perimeter is rectangular. In one embodiment the perimeter can have alternative configurations, such as, for example, tubular, oval, oblong, irregular, non-uniform, variable, and/or tapered. In one embodiment, the edge is rounded. In one embodiment, the edge can have alternative configuration, such as, for example, oval, oblong, irregular, non-uniform, variable, and/or tapered. The edge includes corners 28 in the foot section. In various embodiments, the corners are rounded to prevent the blade from catching or snagging the interior of a compression garment in the process of a user donning the compression hose. In some embodiments, the blade includes a wing section 30 where the width of the blade is W2. In various embodiments, the portions adjacent the wing section comprises a width W1, where W2 is greater than W1. The wing section is configured to ease the task of pulling the compression hose over the heel of the user's foot.

In some embodiments, the inner surface of the blade includes surface geometries configured to affect the tribological interaction between the inner surface and the user's foot. In some embodiments, at least a portion of the inner surface may be rough, textured, porous, semi-porous, dimpled, knurled, toothed and/or grooved. The surface geometry of the inner surface is configured to increase the friction between the user's foot and the inner surface such that the blade does not slide relative to the user's foot in the process of donning the compression hose. However, the opposing outer surface is configured to reduce the friction between the compression hose and the blade. As such, the outer surface is smooth and polished relative to the inner surface. The outer surface includes a lower co-efficient of friction than the inner surface.

In various embodiments, as shown in FIGS. 1-3, the proximal end includes the handle. The handle is configured to maneuver the blade. In one embodiment, the handle and the blade are formed as a single monolithic piece. In one embodiment, the handle may be disposed with the blade in alternate configurations, such as, for example, a friction fit, pressure fit, locking protrusion/recess, locking keyway and/or adhesive. In one embodiment, the proximal end includes a sleeve 14. The sleeve comprises an inner surface (not shown) defining an opening (not shown) having the handle positioned therein. In one embodiment, the sleeve is removably attached to the handle. In one embodiment, the sleeve is fixedly attached to the handle via alternate fixation configurations, such as, for example, a friction fit, pressure fit, locking protrusion/recess, locking keyway and/or adhesive. The sleeve is configured to provide the user with a gripping surface. In some embodiments, the sleeve comprises a rubber exterior. In one embodiment, the sleeve is rough, textured, porous, semi-porous, dimpled, knurled, toothed and/or grooved.

In some embodiments, the handle is configured for maneuvering the blade to assist the user in donning a compression hose. In some embodiments, the handle is further configured to remove the blade after the user has donned the compression hose.

In one embodiment, as shown in FIGS. 4-10, device 10 comprises an elongated, flexible blade 50 extending between a distal end 80 and an opposing proximal end 82. A longitudinal axis C extends between the distal end and the proximal end and a transverse axis D extends along the distal end. In one embodiment, the proximal end includes a handle 46 configured to maneuver the flexible blade. In some embodiments, a longitudinal axis L extends the entire length of the device from the blade to the handle.

The blade comprises a leg section 58 and a foot section 62. The blade is flexible such that the leg section bends, conforms and/or contacts to a rear profile of a user's lower leg, and the foot section conforms and/or contacts to a profile of a user's foot, such as, for example, a sole, sides and/or the heel. The blade includes an inner surface 70 and an opposing outer surface 72. The leg section and the foot section extend from the bottom of a user's forefoot to a user's lower calf, and substantially conforms and/or contacts to that profile.

Figure 7:
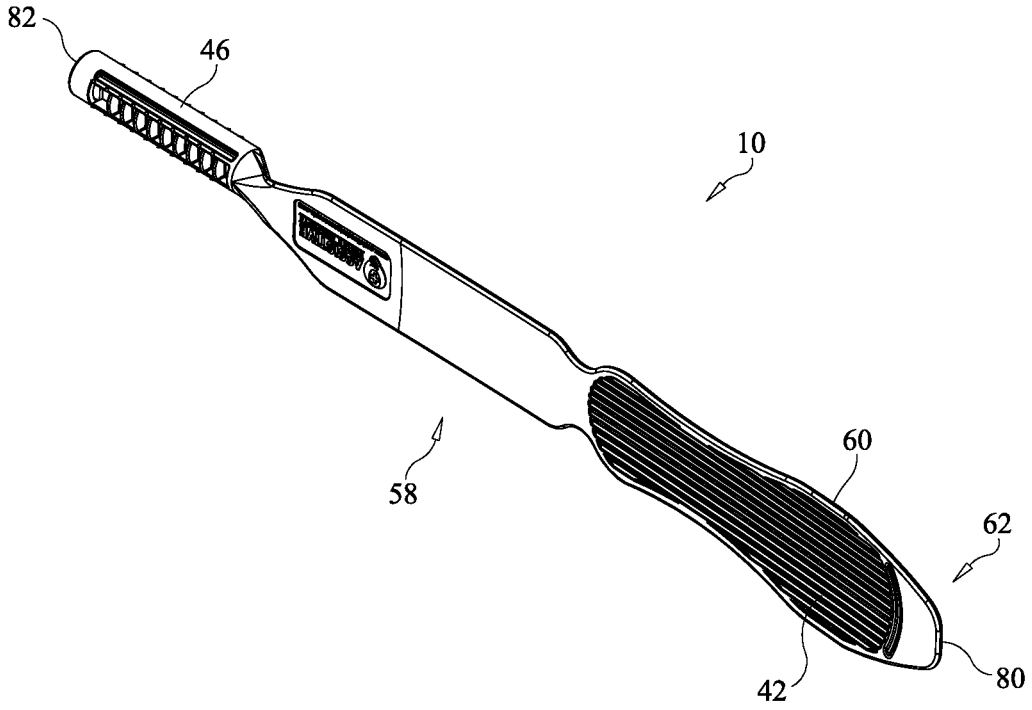
FIG. 7 is a perspective view of components of the device, as shown in FIG. 4.
Figure 8:
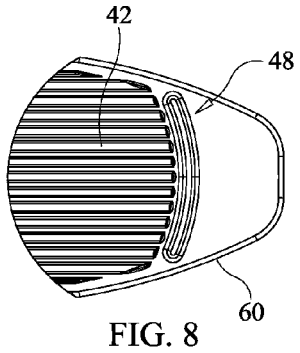
FIG. 8 is a side view of a component of the device, as shown in FIG. 4.

In various embodiments, as shown in FIGS. 7 and 8, the inner surface, similar to inner surface 22, includes a surface geometry 42. In some embodiments, the surface geometry extends through the entire length of the foot section to enhance the tribological properties of the inner surface. In some embodiments, a controlled texture is added to one of two of the surfaces and relative motion reduces the wear while increasing the load capacity of the textured surface. In various embodiments, the controlled texture will increase the life of the device. In some embodiments, the surface geometry is not limited to, but may comprise of striations, ridges, grooves, channels, corrugations, depressions, crimps and/or furrows running parallel to the longitudinal axis. In some embodiments, the inner surface has at least a portion that is textured relative to the smooth outer surface and at least a portion comprising a plurality of ridges. In various embodiments, the at least a portion of the inner surface that is textured is disposed at the proximal end of the blade and the plurality of ridges comprises a portion that is elevated and is disposed at least on the distal end of the blade. In some embodiments, the plurality of ridges includes protrusions. In some embodiments, the surface geometry of the inner surface comprises Mold-Tech® (Mold-Tech Inc., 5166 Barthel Industrial Drive NE, Albertville, Minn. 55301).

In some embodiments, the inner surface includes a guiding mark 48 disposed in a transverse orientation relative to longitudinal axis C, and is disposed at the distal end of the blade. The guiding mark is configured to guide a user during placement of the user's foot onto the blade. In some embodiments, the guiding mark is not limited to, but may be a groove, indentation, and/or protrusion.

Figure 10:
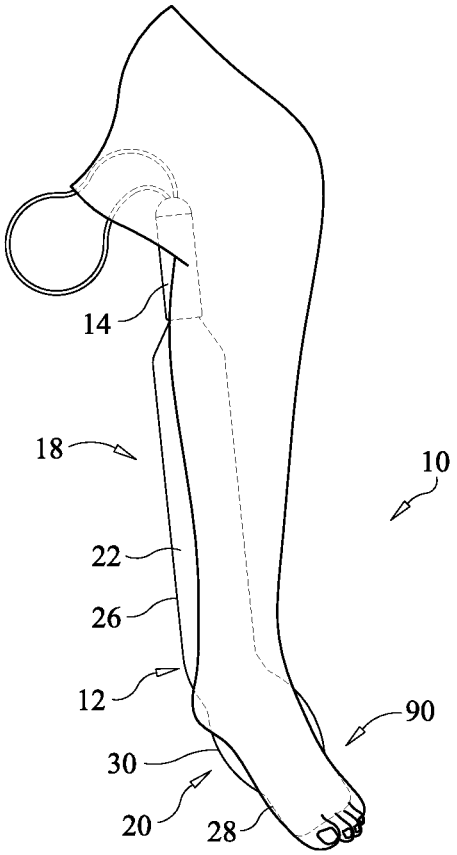
FIG. 10 is a perspective view of the device, as shown in FIG. 1 employed by a user.

In some embodiments, the outer surface includes a raised portion 54 on the distal end of the blade. The raised portion is configured to create a space between a supporting surface 90, as shown in FIG. 10, and the outer surface, such that the blade is not completely flat against the supporting surface and the compression hose is able to slip beneath the blade. In various embodiments, the raised portion defines a depression 64. In various embodiments, the raised portion is not limited to but may be a bump, knob, ledge, point, protrusion, extension, ridge and/or rim. In some embodiments, at least a portion of the user's foot is positioned above the raised portion on or adjacent the inner surface on a plurality of ridges. In some embodiments, the outer surface has a polished finish with a lower coefficient of friction than the inner surface.

In some embodiments, a side 60 and corners 68 of the blade are smooth with rounded edges to prevent the blade from undesirably catching or snagging on the interior of the compression hose. In various embodiments, the blade includes a pair of bilateral indents 40 extending inward from opposite sides of the blade between the foot section and the leg section. The indents are configured to increase the flexibility of the blade at a juncture 78. In some embodiments, the juncture includes a smaller width relative to the foot section and the leg section. The smaller width of the juncture increases the flexibility of the blade at that portion. The blade is configured to bend around, conform and/or contact a user's heel as the user dons the compression hose.

Figure 5:
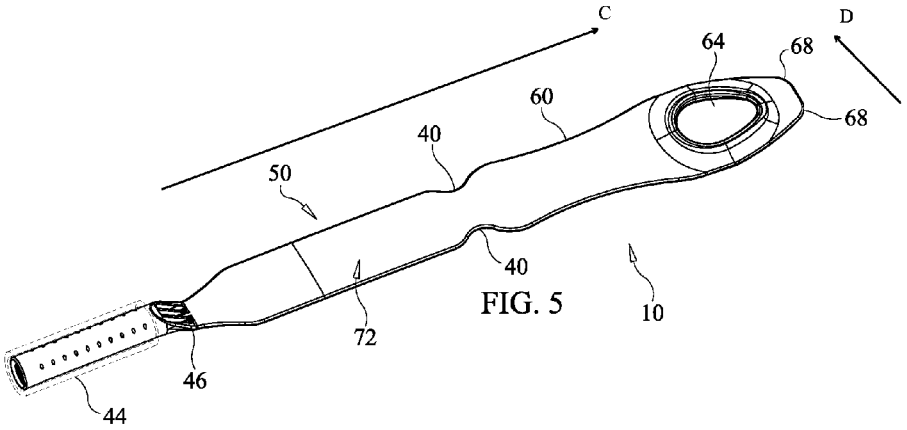
FIG. 5 is a perspective bottom view of components of the device, as shown in FIG. 4.
Figure 6:
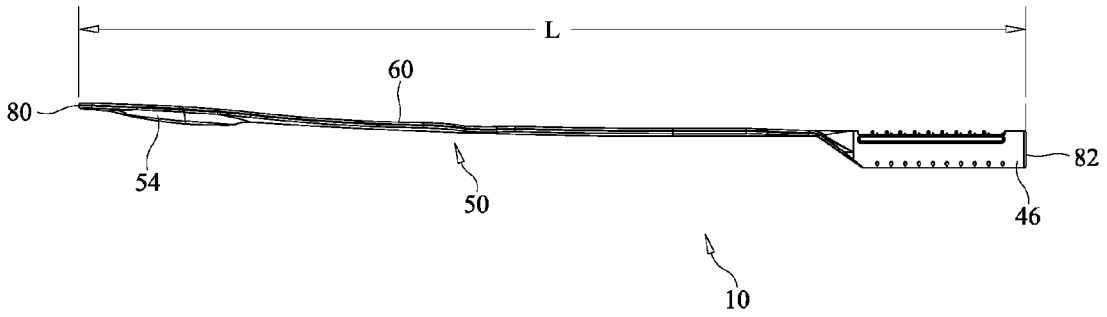
FIG. 6 is a side cross sectional view of components of the device, as shown in FIG. 4.
Figure 9:
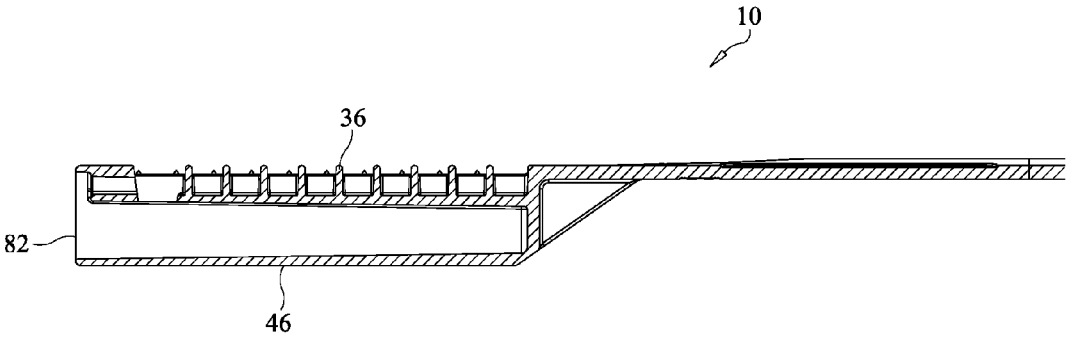
FIG. 9 is a side cross-sectional view of components of the device, as shown in FIG. 4.

In some embodiments, as shown in FIGS. 5 and 9, the proximal end includes a handle 46. In various embodiments, the handle is offset from longitudinal axis C. In some embodiments, the handle and the blade are formed as a single monolithic piece. In some embodiments, handle 46 is fixedly attached to the blade. The handle includes a surface 35 defining surface geometry, such as, for example a channel 36. The channel extends perpendicular to longitudinal axis C, and is configured to secure a sleeve 44. In alternate embodiments, the channel may comprise striations, ridges, grooves, corrugations, depressions, crimps and/or furrows that run perpendicular to longitudinal axis C.

The sleeve is removably attached to the handle at the proximal end of the blade. The sleeve includes an inner surface (not shown) defining an opening 45 configured for disposal with the handle. In some embodiments, sleeve 44 is similar to sleeve 14 and is configured as a gripping surface for a user. In some embodiments, the sleeve comprises a rubberized exterior. The handle is configured to allow a user to easily maneuver the device while donning the compression hose. Once the compression hose is donned, the handle is configured to allow a user to remove the device.

Method of Use

In some embodiments, as illustrated in FIG. 10, a method is provided on how a user employs the donning device for donning compression hose. The user first places the device on a surface, such as, for example, supporting surface 90. Then, the user places the plantar side of his or her foot on inner surface 22, such that the foot section 20 is underneath the user's sole and/or heel and rounded wings 30 are positioned proximately on either side of the user's forefoot. Placing pressure on the foot section with the user's foot, the user would then align the leg section 18 along the calf of the user's lower leg. As stated above, the inner surface of blade 12 is configured to bend, conform and/or contact to the lower part of at least a portion of the user's leg and/or foot. Next, the user places an open end of the compression hose around his or her toes and pulls the compression hose up to the ankle, over the heal and pulls the compression hose up the leg against outer surface 24 of the blade. As discussed above, the rounded wings are configured to facilitate pulling the compression hose over the user's heel, while the smooth surface reduces the friction between the compression hose and the blade. The user then raises his or her leg and pulls the compression hose up their lower leg. Once the user has appropriately donned the compression hose, the user releases the device by pulling it out from the compression hose by handle 16.

Device Formation

In various embodiments, the device of the present disclosure may be formed through vacuum pulling, computer numerical control (CNC) machining, or injection molding. In some embodiments, the device is molded as a single piece from a smooth flexible material such as, for example, polypropylene and/or polyethylene. In some embodiments, the device is molded from Marlex® 9018 50:50 Polyethylene (Chevron Phillips Chemical Company, LP, P.O. Box 4910, The Woodlands, Tex. 77387-4910). In some embodiments, the device is molded from Marlex® High Density Polyethylene (HDPE) (Chevron Phillips Chemical Company, LP, P.O. Box 4910, The Woodlands, Tex. 77387-4910). In some embodiments, the device is molded from about 90% HDPE and about 10% Low Density Polyethylene (LDPE). In some embodiments, the device is molded from about 80% HDPE and about 20% LDPE. In some embodiments, the device is molded from about 75% HDPE and about 25% LDPE. In some embodiments, the device is molded from about 60% HDPE and about 40% LDPE. In some embodiments, the device is molded from about 50% HDPE and about 50% LDPE. In various embodiments, HDP provides the stiffness required for high speed machining of the device, whereas LDPE provides the flexibility required for the user to easily don the compression hose. In various embodiments, device 10 is flexible enough to allow it to bend from the top to the bottom and twist from side-to-side. In various embodiments, the device is also stiff enough so as to substantially prevent the device from bending from side-to-side along its length.

In some embodiments, the blade comprises a polymer having a modulus of elasticity from about 1 MPa to about 100 MPa. In some embodiments, the modulus of elasticity is about 1, 2, 3, 4, 5, 6, 7, 8, 9, 10, 11, 12, 13, 14, 15, 16, 17, 18, 19, 20, 21, 22, 23, 24, 25, 26, 27, 28, 29, 30, 31, 32, 33, 34, 35, 36, 37, 38, 39, 40, 41, 42, 43, 44, 45, 46, 47, 48, 49, 50, 51, 52, 53, 54, 55, 56, 57, 58, 59, 60, 61, 62, 63, 64, 65, 66, 67, 68, 69, 70, 71, 72, 73, 74, 75, 76, 77, 78, 79, 80, 81, 82, 83, 84, 85, 86, 87, 88, 89, 90, 91, 92, 93, 94, 95, 96, 97, 98, 99 and/or 100 MPa.

The present disclosure may, of course, be carried out in other ways than those specifically set forth herein without departing from essential characteristics of the disclosure. For example, the specification and drawings describe the present disclosure in the context of a user donning compression hose. However, users may also employ the present disclosure to assist in removing the compression hose. Therefore, the present embodiments are to be considered in all respects as illustrative and not restrictive, and all changes coming within the meaning and equivalency range of the appended claims are intended to be embraced therein.

What is claimed is:

1. A device for donning hosiery comprising: an elongated flexible blade extending between a distal end and a proximal end, wherein the blade is configured to contact at least a portion of a user's foot, and having a textured inner surface configured to face towards the user's lower leg, and an opposing smooth outer surface relative to the textured inner surface, the outer surface comprising a raised portion defining a depression disposed on the distal end of the elongated flexible blade.

2. A device according to claim 1, wherein the inner surface is concave and the outer surface is convex.

3. A device according to claim 1, wherein the outer surface is continuously smooth between the distal and proximal ends to allow the user to slide the hosiery along the device.

4. A device according to claim 1, wherein the textured inner surface of the blade comprises ridges.

5. A device according to claim 1, wherein the outer surface of the blade includes a lower co-efficient of friction than the inner surface of the blade.

6. A device according to claim 1, wherein the blade includes a wing section with an increased width measured across a longitudinal axis, the wing section configured to create a space between the hosiery and the user's foot, the wing section being adjacent to the distal end of the blade.

7. A device according to claim 1, wherein the device comprises a handle disposed at the proximal end of the blade, and the device comprises a sleeve comprising an inner surface defining an opening having the handle positioned therein, and the sleeve being fixedly attached to the handle.

8. A device according to claim 7, wherein the sleeve comprises a gripping surface.

9. A device for donning hosiery comprising: an elongated flexible blade configured to bend and contact at least a portion of a user's foot, the blade comprising an inner surface configured to face towards a portion of the user's lower leg, and an opposing smooth outer surface, the inner surface having at least a portion that is textured relative to the smooth outer surface and at least a portion comprising a plurality of ridges, and the blade comprising a raised portion extending from the smooth outer surface and defining a depression, the raised portion being disposed on a distal end of the blade and configured to create a space between a surface, such that at least a portion of the user's foot is configured to be positioned above the raised portion on or adjacent the inner surface on the plurality of ridges.

10. A device according to claim 9, wherein the smooth outer surface is continuously smooth between the distal end and a proximal end of the blade to allow the user to slide the hosiery along the device, and the at least a portion of the inner surface that is textured is disposed at the proximal end of the blade and the plurality of ridges comprises a portion that is elevated and is disposed at least on the distal end of the blade.

11. A device according to claim 10, wherein the blade comprises an offset angled handle relative to the blade, the handle being disposed at the proximal end of the blade, and the device comprises a sleeve comprising an inner surface defining an opening configured for disposal of the handle, the sleeve being removably attached to the handle.

12. A device according to claim 11, wherein the handle includes at least one channel extending perpendicular to a longitudinal axis to secure the sleeve to the handle.

13. A device according to claim 10, wherein the blade comprises a pair of opposing bilateral indents disposed between the distal end and the proximal end, each of the indents having an arcuate shape to aid the user in donning the hosiery.

14. A device according to claim 9, wherein the inner surface of the blade decreases the sliding friction between the inner surface and at least a portion of the user's foot.

15. A device according to claim 10, wherein (i) the blade is wider at the distal end than at the proximal end so as to mimic a configuration of at least a portion of the user's foot; and (ii) the raised portion extending from the smooth outer surface opposes the plurality of ridges of the inner surface.

16. A device according to claim 10, wherein the blade includes a groove on the inner surface of the distal end, the groove extending transverse to a longitudinal axis and being configured to guide the placement of the user's foot.

17. A method of using the device of claim 1 for donning hosiery, the method comprising: providing a donning device comprising an elongated blade extending between a distal end and an opposing proximal end, wherein the blade is flexible and configured to bend and contact at least a portion of the user's foot, the blade having an textured inner surface configured to face the user's lower leg, and an opposing smooth outer surface relative to the textured inner surface configured to face a supporting surface that at least a portion of the user's foot is positioned above; placing the device on the supporting surface; placing the user's foot on the inner surface; capturing the device and the user's foot with the hosiery; pulling the hosiery to the ankle; pulling the hosiery over the heel; raising the user's foot and pulling the hosiery up the user's lower leg; and releasing the device from the hosiery.

18. A method according to claim 17, wherein the textured inner surface of the blade comprises ridges and the outer surface of the blade includes a lower co-efficient of friction than the inner surface of the blade to enable the user to slip the hosiery beneath the device.

19. A method according to claim 17, wherein the blade includes a wing section with an increased width measured across a longitudinal axis, the wing section configured to create a space between the hosiery and the user's foot, the wing section being in closer proximity to the distal end than the proximal end of the blade.

20. A method according to claim 17, wherein pulling the hosiery to the ankle comprises sliding the hosiery along the outer surface wherein the outer surface is continuously smooth between the distal and proximal ends to allow the user to slide the hosiery along the device without obstruction.

* * * * *